US005699692A

United States Patent [19]

Lonero et al.

[11] Patent Number: 5,699,692

[45] Date of Patent: Dec. 23, 1997

[54] NEW TOOL MECHANISMS FOR DEEP ROLLING MACHINES

[75] Inventors: Vincent J. Lonero, Bloomfield Hills; Shawn D. Luteran, Waterford, both of Mich.

[73] Assignee: Lonero Engineering CO., Inc., Troy, Mich.

[21] Appl. No.: 741,044

[22] Filed: Oct. 30, 1996

[51] Int. Cl.[6] ..... B21B 27/10

[52] U.S. Cl. ..... 72/110; 72/463

[58] Field of Search ..... 72/41, 44, 110, 72/463

[56] References Cited

U.S. PATENT DOCUMENTS

| | | | |
|---|---|---|---|
| 3,556,163 | 1/1971 | Pfarrwaller et al. . | |
| 4,134,314 | 1/1979 | Luzina . | |
| 4,442,689 | 4/1984 | Senatore | 72/41 |
| 4,561,276 | 12/1985 | Berstein . | |
| 4,947,668 | 8/1990 | Osterag . | |
| 5,001,917 | 3/1991 | Berstein . | |
| 5,138,859 | 8/1992 | Winkens . | |
| 5,235,838 | 8/1993 | Berstein . | |
| 5,333,480 | 8/1994 | Berstein . | |
| 5,445,003 | 8/1995 | Gottschalk et al. . | |
| 5,493,761 | 2/1996 | Bone . | |
| 5,495,738 | 3/1996 | Gottschalk . | |

*Primary Examiner*—Lowell A. Larson
*Attorney, Agent, or Firm*—Dinnin & Dunn, P.C.

[57] ABSTRACT

A lower work tool having a one-piece open style design with a plurality of openings and an upper work tool having a housing and cover plate each forming a plurality of openings.

12 Claims, 2 Drawing Sheets

NEW TOOL MECHANISMS FOR DEEP ROLLING MACHINES

FIELD OF THE INVENTION

This invention broadly relates to deep rolling of fillets of engine crankshafts or other annular areas of metallic work pieces subject to high stress loads. More specifically, this invention relates to new tool mechanisms for deep rolling machines for use in the deep rolling of crankshafts or like work pieces.

BACKGROUND OF THE INVENTION

The state of the art is indicated by following cited references: Gottschalk, U.S. Pat. No. 5,495,738; Gottschalk, et al., U.S. Pat. No. 5,445,003; Bone, U.S. Pat. No. 5,493,761; Winkens, U.S. Pat. No. 5,138,859; Betsrein, U.S. Pat. No. 4,561,276; and Ostertag, U.S. Pat. No. 4,947,668.

Various machines and methods have been employed to strengthen and finish metal work pieces such as camshafts and crankshafts for internal combustion engines. In many modern automobiles, engines have been downsized for installation into smaller vehicles. Accordingly, with downsizing of automotive vehicles and their components for reducing weights and improving fuel efficiency, smaller engines and crankshafts are needed.

To improve the fatigue strength and durability of downsized crankshafts, deep rolling of fillets and other circular joint areas is increasingly important. The fatigue strength and durability of crank pins and main bearing journals can be significantly increased by deep rolling compressive stresses into the middle of the annular fillets between the pin journals and adjacent counterweights or balancing webs.

During this deep rolling process, the industry has long known to provide a full flooding process necessary to lubricate and/or cool the work tools and work piece while the work tools are engaging the work piece. A more recent process of lubricating and/or cooling includes a limited coolant supply in the form of a mist (e.g., lubricant mist). Both of these cooling/lubricating methods tend to cause shavings from said work piece and any other debris or foreign matter in the work area to adhere to the work piece and work tool mechanisms.

The adherence of debris to the work tools and work pieces create many problems for the industry. First, there is considerable wear and tear of the tool mechanisms effectively shortening tool life. Second, to increase the life and performance of the work tools, many man hours are required to disassemble the work tools for cleaning, and to later re-assemble for subsequent use of the cleaned tools. Consequently, productivity is greatly diminished because the work tools cannot be used in the deep rolling process during the cleaning process. Third, debris collecting around the work area may work its way between the work tool and work piece during the deep rolling process to cause the compressive stresses to be misaligned effectively negating the purpose of the deep rolling process. Accordingly, those skilled in the art have long sought a solution for keeping the work tools and work piece clear of debris and other foreign matter during the deep rolling process, particularly where a fluid mist or lubricant mist is used in the work tool process.

One object of the present invention is to provide a novel design of the work tool in which disassembly of the work tool for cleaning is unnecessary.

Another object of the present invention is to provide a design of the lower work tool that permits easy assembly and disassembly if necessary for the cleaning process.

Still another object of the present invention is to provide a novel design of the work tools that can be cleaned in conventional ultrasonic cleaning systems without disassembly.

Other objects, features and advantages of the present invention will become apparent from the subsequent description and the appended claims, taken in connection with the accompanying drawings (wherein like numerals indicate like elements).

SUMMARY OF THE INVENTION

According to the present invention, the foregoing and other objects and advantages are attained by novel designs for the upper and lower work tools used to apply the compressive stresses in the deep rolling process. According to the unique design of the tipper and lower work tools, the design provides for and includes a plurality of openings to allow foreign matter and debris to pass through the tools during the deep rolling process.

While not previously known or used in industry, the designs for each tool having a plurality of openings to allow for debris to be swept through the openings by the lubricating solution of the deep rolling process. With debris prevented from adhering and collecting around the work tool or work piece, the necessity to remove the work tool from the deep rolling process for cleansing is greatly diminished.

Accordingly, production is not wasted removing the work tool from a deep rolling project to have the tool cleansed. Similarly, man hours are not wasted cleaning the work tools since the frequency of cleaning is reduced.

An added benefit is the cleanliness of the work piece. With the debris capable of being swept away from the work piece, a cleaner product results and is always welcomed by the customer. Furthermore, debris is less likely to be collected around the area where the work tool engages the work piece during the deep rolling process. Consequently, a more precise deep rolling process results creating the most effective compressive stresses possible in the annular fillets.

When cleaning the work tools is necessary, the plurality of openings allows the work tools to be thoroughly cleaned in conventional ultrasonic cleaning systems without complete disassembly.

DESCRIPTION OF THE PREFERRED EMBODIMENTS AND BEST MODE OF CARRYING OUT THE INVENTION

Figure 1:
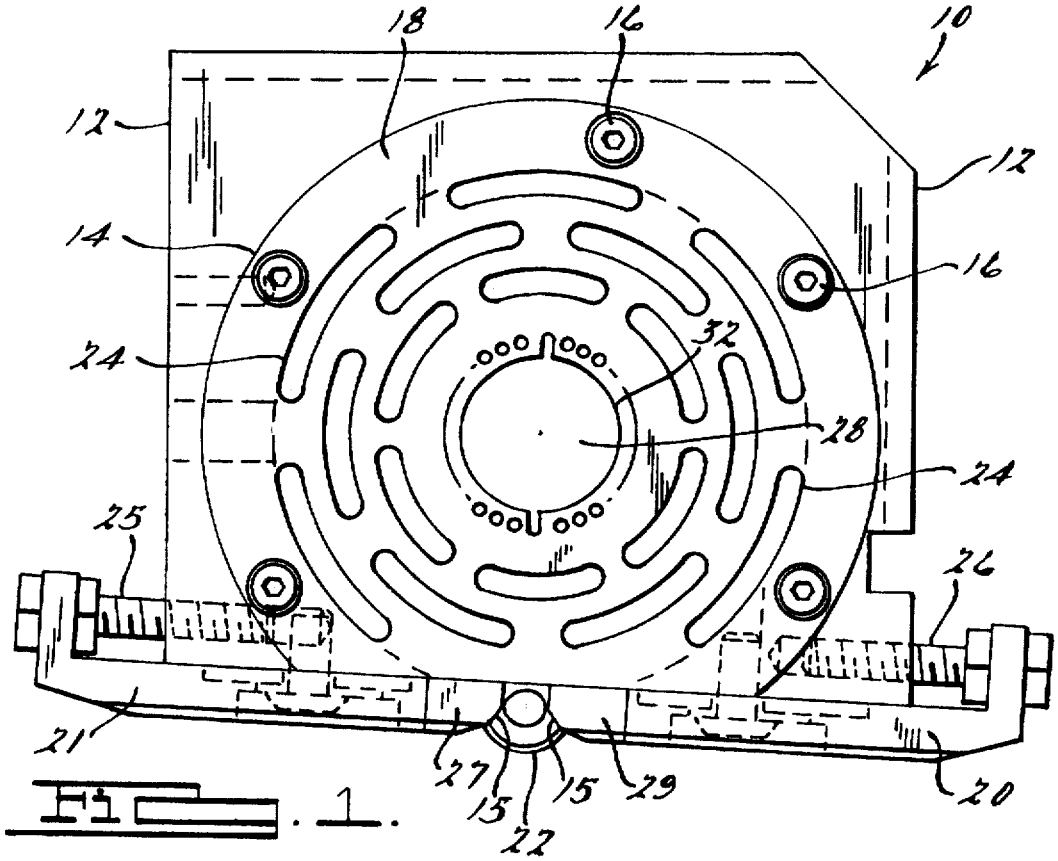
FIG. 1 is a side view of the upper work tool in accordance with the invention used in the deep rolling process of fillets.

FIG. 1 illustrates an upper work tool 10 in accordance with the present invention.

Figure 2:
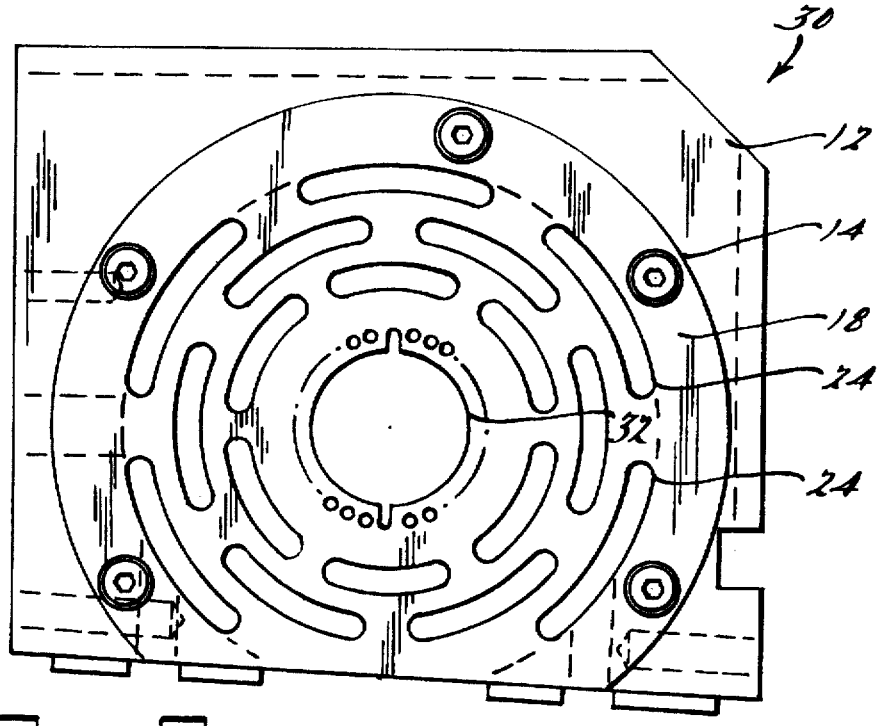
FIG. 2 is a side view of just the housing portion and cover plate of FIG. 1 showing the present invention.
Figure 3:
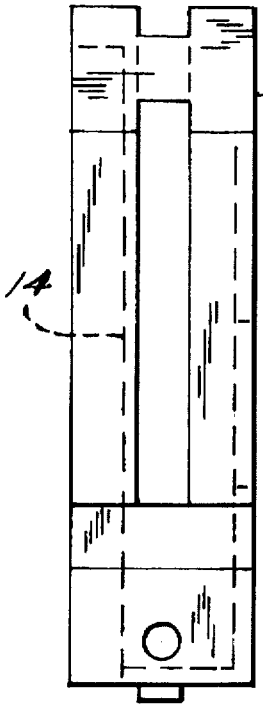
FIG. 3 is a right side end view of the housing of FIG. 2.

The tool 10 comprises a rectangular housing 12 having one side forming an annular opening 14. Said annular opening 14 is closed by an annular cover plate 18 which is secured to the housing 12 by threaded fasteners 16. The cover plate 18 forms an annular recess 32 to receive one end of a cylindrical hub 28. The combination 30 of just the housing 12 and cover plate 18 of the present invention is more fully illustrated in FIG. 2.

As shown in FIG. 1, the housing 12 has a pair of L-shaped work roller retainers 20, 21 adjustably secured by the threaded fasteners 25, 26. Said retainers 20, 21 have ends 27, 29 which are recessed to provide cages 15. Said cages 15 support work rollers 22 for floating rotation generally about upwardly and outwardly so that the working circumference of said rollers 22 can engage fillets of crankshaft journals or other similar work pieces to deep roll compressive stresses in said work pieces. This design for the upper work tool is generally known in the industry as illustrated by U.S. Pat. No. 5,445,003 to Gottschalk et al., and referenced herein.

However, none of the referenced patents teach a cover plate having a plurality of openings, nor do the patents teach a housing having a plurality of openings. The cover plate 18 of the present invention forms a first plurality of openings 24 in the shape of disjoined concentric circles radiating outwardly from the center of said cover plate 18. Additionally, a side 13 of the housing 12 opposite the annular opening 14 also forms a second plurality of openings in the shape of disjoined concentric circles (not shown) radiating outwardly from the center of said side 13, said first plurality of openings 24 aligned with the second.

Figure 5:
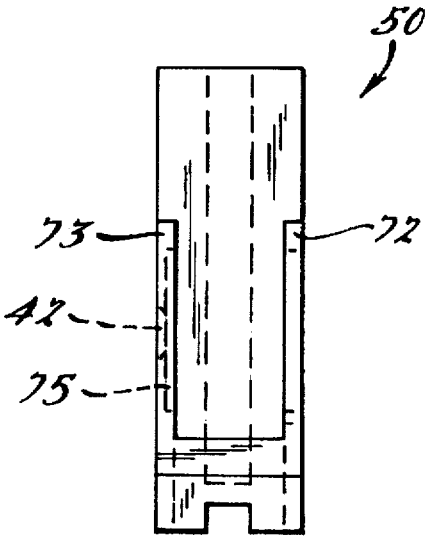
FIG. 5 is a left end view of just the main body of FIG. 4.
Figure 4:
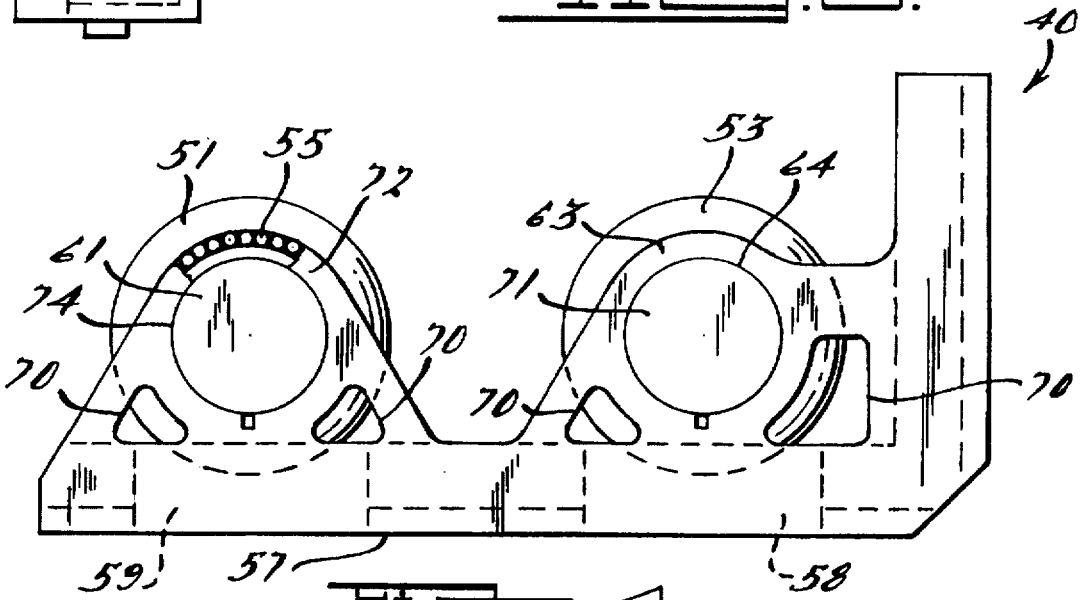
FIG. 4 is a side view of the lower work tool including a cut away view of one ridge showing the present invention.
Figure 6:
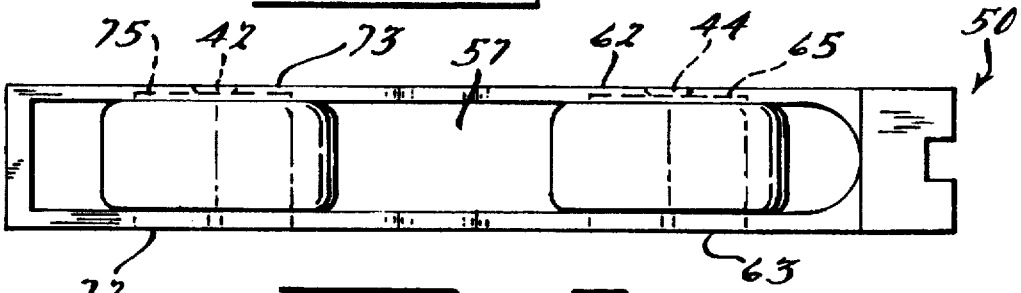
FIG. 6 is a top view of FIG. 5.

FIG. 4 illustrates a side view of a lower work tool 40 of the present invention comprising a main body essentially forming an L shape member with a longitudinal axis 57 integrally supporting two laterally spaced sides allowing for a one-piece open design of the lower work tool as illustrated in FIGS.4, 5 and 6. Each side is symmetrically aligned relative to the other comprising a pair of spaced ridges 62, 72 and 63, 73 with each ridge forming an annular race 64, 74, 65, 75. Two hubs 61, 71 are axially positioned between the sides and supported by oppositely aligned races with said hubs secured to said ridges 73, 62 by flat head screws (not shown), said screws positioned through tapered openings 42, 44 respectively. A pair of receiving rollers 51, 53 are rotatably supported by needle beatings 55 (as illustrated in FIG. 4 with view of cut away of ridge 72) with said needle bearings 55 supported by said hubs 61, 71.

Since the lower work tool is routinely beneath the work piece during the deep rolling process, the bulk of the debris collects around this tool, and consequently, may require disassembly for a thorough cleaning. When disassembly is required, the one-piece open design permits easy assembly and disassembly. Only the hubs 61, 71 and rollers 51, 53 are required to be removed and is easily accomplished by simply removing the hubs and rollers from the open end of the tool 40. Therefore, when cleaning is necessary, only a minimal amount of man hours is needed to clean the tool and down time for the tool is greatly diminished increasing productivity considerably.

The longitudinal axis 57 of said lower work tool 40 forms two rectangular openings 58, 59, as illustrated in FIG. 6, positioned beneath said hubs during the deep rolling process and are large enough to allow a smooth flow of lubricating fluid and debris to pass said receiving rollers 51, 53. Additionally, the ridges 62, 72, 63, 73 form a plurality of openings 70 leaving just enough structure for each ridge to adequately support said hubs 61, 71 during the deep rolling process. With this combination of openings, the bulk of debris is able to effectively pass the work tools and work piece.

While it will be apparent that the preferred embodiments of the invention disclosed are well calculated to fulfill benefits, objects or advantages of the invention, it will be appreciated that the invention is susceptible to modification, variation and change without departing from the proper scope or fair meaning of the subjoined claims.

What is claimed is:

1. A tool mechanism for use in the deep rolling of crankshafts or like products, comprising:

a) a housing having a side forming an annular opening, b) a cage formed at one end of said housing, c) work rollers operatively mounted in said cage and operatively inclined outward to physically engage a fillet of said crankshaft, and d) at least one annular cover plate secured to said housing at said annular opening, said annular cover plate having a plurality of openings.

2. The tool mechanism of claim 1 wherein said housing forms a second plurality of openings at a side opposite said annular opening.

3. The tool mechanism of claim 2 wherein said first and second plurality of openings form disjoined concentric circles radiating outwardly from the center of said housing and cover plate, respectively.

4. The tool mechanism of claim 1 wherein said housing and cover plate are manufactured from 4140 preheat, armorclad coat, steel.

5. A tool mechanism for use in the deep rolling of crankshafts or like products, comprising:

a) two receiving rollers, b) a pair of spaced hubs rotatably supporting said receiving rollers, and c) a main body essentially forming an L shape member, said L shape member supporting two laterally spaced sides, each side is symmetrically aligned relative to the other and each side forms a pair of spaced ridges, with said ridges supporting said hubs.

6. A tool mechanism of claim 5 wherein said main body and ridges form a plurality of openings.

7. A tool mechanism of claim 5 wherein said main body is manufactured from 4140 preheat, armorclad coat, steel.

8. A tool mechanism for use in the deep rolling of crankshafts or like products, comprising:

a) a housing having a side forming an annular opening, b) a cage formed at one end of said housing, c) work rollers operatively mounted in said cage and operatively inclined outward to physically engage a fillet of said crankshaft, d) at least one annular cover plate secured to said housing at said annular opening, said annular cover plate having a plurality of openings, e) two receiving rollers, f) a pair of hubs rotatably supporting said receiving rollers, and g) a main body essentially forming an L shape member, said L shape member supporting two laterally spaced sides, each side is symmetrically aligned relative to the other and each side forms a pair of spaced ridges, with said ridges supporting said hubs, said receiving rollers engage said fillet of said crankshaft opposite said engagement by said work rollers during the deep rolling process.

9. The tool mechanism of claim 8 wherein said housing forms a second plurality of openings at a side opposite said annular opening.

10. The tool mechanism of claim 9 wherein said first and second plurality of openings form disjoined concentric circles radiating outwardly from the center of said housing and cover plate, respectively.

11. A tool mechanism of claim 8 wherein said main body and ridges form a plurality of openings.

12. A tool mechanism of claim 8 wherein said main body and housing is manufactured from 4140 preheat, armorclad coat, steel.

* * * * *